United States Patent [19]

Albrecht et al.

[11] 4,392,314

[45] Jul. 12, 1983

[54] BOOM AND DIPPER STICK CONSTRUCTION

[75] Inventors: Allan J. Albrecht, Rothschild; Richard C. Van Ooyen, Schofield, both of Wis.

[73] Assignee: J. I. Case Company, Racine, Wis.

[21] Appl. No.: 349,003

[22] Filed: Feb. 16, 1982

[51] Int. Cl.[3] ..... E02F 5/02

[52] U.S. Cl. ..... 37/103; 29/463; 29/DIG. 48; 414/694

[58] Field of Search ..... 37/103, 117.5; 414/685, 414/687, 688, 694, 695.5, 695, 695.8, 705, 711, 722, 723; 29/150, 155 R, 463, DIG. 48

[56] References Cited

U.S. PATENT DOCUMENTS

| | | | |
|---|---|---|---|
| 2,895,236 | 7/1959 | Pilch | 37/103 |
| 3,527,362 | 9/1970 | Allen | 37/103 X |
| 4,293,270 | 10/1981 | Prime | 414/694 |
| 4,297,815 | 11/1981 | Moro et al. | 37/103 |

FOREIGN PATENT DOCUMENTS

| | | | |
|---|---|---|---|
| 1099234 | 4/1981 | Canada | 37/103 |
| 651299 | 1/1963 | Italy | 37/103 |

*Primary Examiner*—E. H. Eickholt

*Attorney, Agent, or Firm*—Dressler, Goldsmith, Shore, Sutker & Milnamow, Ltd.

[57] ABSTRACT

A boom and dipper stick construction for mobile excavators and an improved method of manufacturing the same. The boom and dipper stick are fabricated from side plates that are butt welded together with respect to various hinge point locations to eliminate the necessity of doubler plates on the sides of the structures. The butt welds are located at non-critical areas to provide for even stress flow and ease of manufacture.

A method of welding together the side plates of the boom and dipper stick construction in an end to end abutting relationship in a manner which attains a complete weld penetration over the entire length of the joint.

13 Claims, 11 Drawing Figures

10
12
14
14
16
18
20
22
26
28
30
32
34
36
37
38
39
40
42
43
45
46
47
48
49
50
51
52
53

120
122
124
126
128
130
132
134
136
138
140
142
144
146
148
150
152
154
156
158
160
162
163
36
4.
4.

122
124
126
130
134
142
150
154
156
160
162
163
36
146

124
142
162
158
138
152
162
124
142

BOOM AND DIPPER STICK CONSTRUCTION

BACKGROUND OF THE INVENTION

The present invention relates generally to material handling devices and more particularly to an improved boom and dipper stick construction for mobile excavators and an improved method of manufacturing the same.

One type of known material handling device, which has been in existence for some time, includes a boom carried by a support for pivotal movement in a substantially vertical plane about a horizontal axis. The boom is generally pivoted on the support by a fluid power means while the support is rotatable about a vertical axis on a self-powered frame.

The free end of the boom pivotally supports a material handling unit, such as a dipper stick having a bucket pivoted thereon. The dipper stick is pivoted relative to the free end of the boom through additional fluid power means while the bucket is pivoted on the dipper stick through a further fluid power means. Devices of this general character are shown in Przybylski U.S. Pat. No. 3,392,855 and Davis U.S. Pat. No. 2,961,106.

The boom and dipper stick are typically fabricated by welding together numerous specifically formed steel plates to form generally box-type structures. The various hinge points are provided with suitble bearings and connecting means welded to the plates. It has heretofore been necessary to provide doubler plates on the side of the structures in the areas of high stress concentrations.

SUMMARY OF THE INVENTION

Briefly stated, the present invention provides a boom and a dipper stick construction which are fabricated from side plates that are butt welded together with respect to the various hinge point locations in a specific manner to eliminate the necessity of doubler plates on the sides of the structures. The butt joint welds are located at non-critical areas to provide for even stress flow and ease of manufacture.

More specifically, the boom construction comprises a pair of spaced apart outside side plate assemblies. The side plate assemblies include first and second connecting ear plates which have first and second bearing means connected thereto for pivotal attachment to the platform and the dipper stick. Front and rear side plates are butt welded together in an end to end relationship and in turn are butt welded to the respective connecting ear plates in an end to end relationship. The front side plates have a third bearing means mounted therebetween for pivotal receipt of a fluid motor means. The rear side plates have a fourth bearing means mounted therebetween for pivotal receipt of a fluid motor means. A top plate assembly is welded between the upper portions of the side plate assemblies and a bottom plate assembly is welded between the lower portions of the side plate assemblies. An inside rear plate is welded between the top plate assembly and the bottom plate assembly and the rear side plates rearward of the fourth bearing means. An inside forward plate is secured between the top plate assembly and the bottom plate assembly and the rear side plates forward of the fourth bearing means. A pair of spaced inside center plates are secured between the inside rear plate and the inside forward plate so as to form a box structure therewith between the rear side plates. The fourth bearing means extend through and are secured to the rear side plates and the adjacent inside center plates.

The dipper stick construction comprises a pair of spaced apart side plate assemblies. The side plate assemblies include upper and lower side plates which are welded in an end to end abutting relationship to an intermediate side plate. The upper side plates have first and second bearing means connected thereto for respective connection to a fluid motor means and the boom. The lower side plates have third bearing means connected thereto for connection to the bucket. The intermediate side plates have fourth bearing means connected thereto for connection to a fluid motor means. The fourth bearing means includes a bearing cylinder extending through and welded to each of the intermediate side plates. A ring plate is received around and welded to each of the bearing cylinders and a corresponding intermediate side plate. An end plate assembly is welded between the side plate assemblies generally adjacent to the outer periphery thereof.

The present invention further provides a unique method for welding together the adjacent edges of a pair of side plates of the boom and dipper stick in an end to end abutting relationship to attain complete weld penetration over the entire length of the joint. In accordance with the method, the side plates are formed with tab portions which extend outwardly therefrom in the direction of the weld adjacent to the respective edges. The side plates are positioned in an end to end relationship with the adjacent edges spaced a short distance apart. A removable back-up strip is positioned along the line of the weld so as to extend between the tab portions. The back-up strip preferably has a groove formed therein in facing relationship to the space between the adjacent edges. Weld material is applied between the adjacent edges along the entire length thereof filling the spaced therebetween and the groove in the back-up strip. The tab portions are trimmed from the side plates and the back-up strip is removed leaving a weld joint which penetrates the entire length of the butt joint.

DETAILED DESCRIPTION OF THE INVENTION

Figure 1:
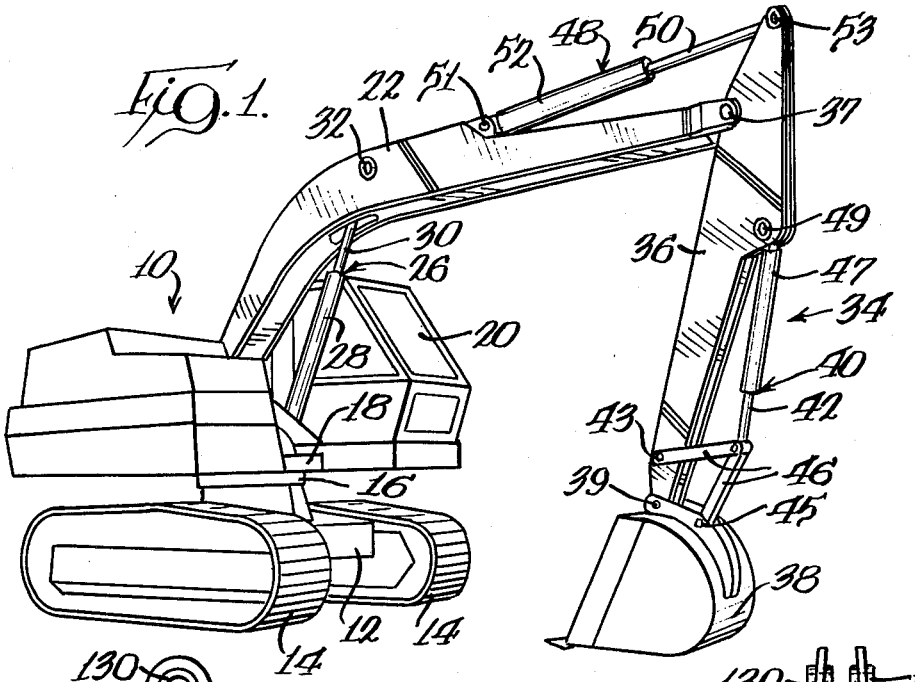
FIG. 1 is a perspective view of a mobil excavator having a boom assembly and dipper stick assembly constructed in accordance with the present invention incorporated therein.
Figure 2:
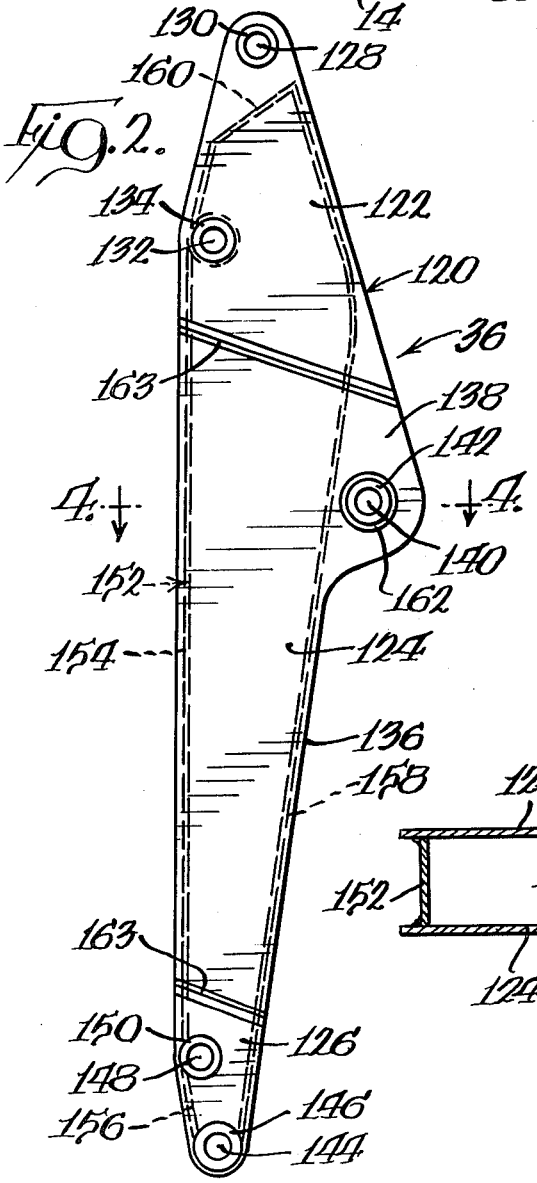
FIG. 2 is an enlarged side elevational view of the dipper stick assembly constructed in accordance with the invention.
Figure 3:
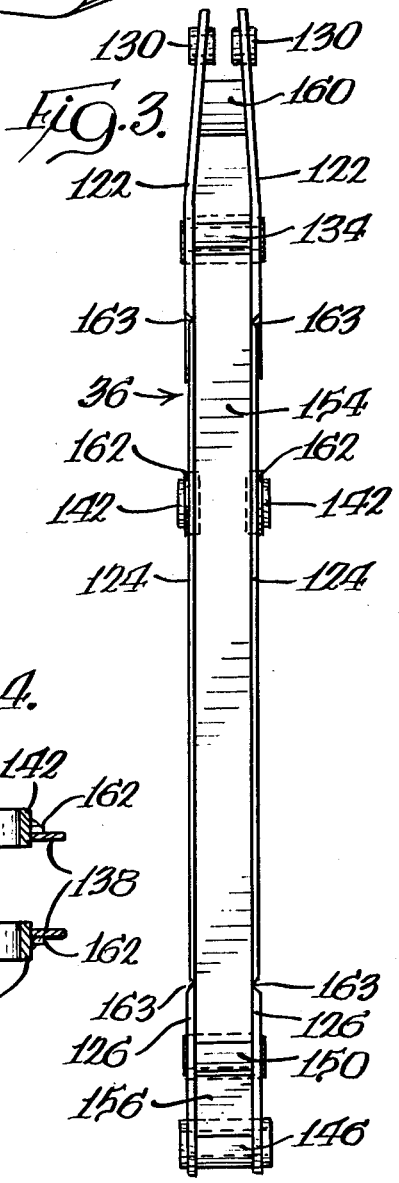
FIG. 3 is an end view of the dipper stick assembly as shown in FIG. 2.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

FIG. 1 of the drawings discloses a mobile excavator, generally designated by the reference numeral 10, of the type which incorporates the boom and dipper stick construction of the present invention. The excavator 10 includes a self-powered framed structure consisting of a frame 12 supported by a pair of endless track chains 14 and defining a circular support 16 adjacent the upper end thereof. A platform or turntable 18 is supported for rotation about a vertical axis on circular table 16 and is rotatable through a complete circle of revolution relative to the frame structure 12.

The platform 18 has an operator's station or cab 20 which is laterally offset from the pivot axis of the platform, and a boom structure, generally designated by the reference numeral 22, which pivots about a horizontal pivot axis. The boom 22 is pivoted about the pivot axis through a single fluid power means 26 having a cylinder 28 pivoted on the platform 18 and piston rod 30 pivotally connected to the boom structure by pin 32.

A dipper assembly 34, including a dipper stick 36, is pivoted intermediate its ends to the free end of boom 22 by pin 37. The remote or opposite end of the dipper stick 36 has a bucket 38 pivotally secured by pin 39 and is movable to any one of a plurality of positions by a mechanism including fluid motor means 40. The interconnection between the piston rod 42 of the fluid motor means 40 and the bucket 44 includes a compound linkage 46 having the adjacent interconnected ends connected to the piston rod 42 of the motor means 40 and the respective outer ends are pivotally connected to the dipper stick 36 by pin 43 and the bucket 44 by pin 45. The cylinder 47 of motor means 40 is pivoted to an intermediate portion of dipper stick 36 by pin 49.

A fluid power means 48, which includes a piston rod 50 extensible and retractable relative to a cylinder 52, pivotally extends between an intermediate portion of boom 22 at pin 51 and an upper portion of dipper stick 36 at pin 53. Fluid power means 48 pivots dipper stick 36 about pin 37.

Referring to FIGS. 1 and 5–7, the specific construction of boom structure 22 in accordance with the present invention will now be specifically described. Boom structure 22 includes a pair of spaced apart outside side plate assemblies 54, which are of identical construction. The specific shape of the plate members which form the assemblies 54 are as required, and shown in the drawings, to form a somewhat arcuate structure and to provide necessary clearances to prevent contact with other parts of the excavator during operation.

Outside side plate assemblies 54 are fabricated from a front connecting ear plate 56, a front side plate 58, a rear side plate 60, and a rear connecting ear plate 62. Plates 56, 58, 60 and 62 are respectively butt welded together in an end to end relationship in a manner which will be specifically described hereinbelow. Front connecting ear plate 56 is formed with an opening 64 through the forward end thereof for receipt of a bearing 66 therethrough. Connecting pin 37 extends through bearings 66 to pivotally secure boom 22 to a portion of dipper stick 36, which is received between the plates 56 of the plate assemblies 54. Rear connecting ear plate 62 is formed with an opening 68 through the rear end thereof for receipt of a bearing 70 therethrough. Plates 62 are pivotally secured to platform 18 through a pin (not shown) which passes through bearing 70 and cooperating structure (not shown) associated with platform 18.

Front side plate 58 is formed with an undercut portion 72, which extends from a rear portion thereof towards plate 56. Undercut portion 72 permits the necessary relative movement of fluid motor means 48. A tubular beam member 74 extends between the rear portions of the facing plates 58 adjacent the upper edges thereof. A pair of spaced apart mounting struts 76 are welded to member 74 and extend forwardly therefrom towards the undercut portion 72. Arms 76 are formed with openings 78 formed therein for receipt of bearings 80 therethrough. Cylinder 52 of fluid motor means 48 is secured to plates 58 by pin 51 which extends through bearings 80 and connecting ears associated with cylinder 52.

Rear side plate 60 is of generally arcuate shape and is formed to smoothly extend between plates 58 and 62. Plate 60 is formed with an opening 82 through an intermediate portion thereof for receipt of bearings 84 therethrough. Piston rod 30 of fluid motor 26 extends between the bearings 84 associated with the facing plates 60 and is pivotally secured thereto by pin 32 which extends through bearings 84 and piston rod 30.

A top plate assembly 86 is welded between the outside side plate assemblies 54 generally adjacent to the upper peripheries thereof. Top plate assembly 86 includes a pair of plates 88 and 90, which are welded together in an end to end abutting relationship at 92. Plate 88 is welded at one end to bearing 70 and extends above bearings 84 and terminates at its other end a short distance from plate 58. Plate 90 extends from the forward edge of plate 88 below beam 74 and terminates a short distance from plate 56.

Figure 11:
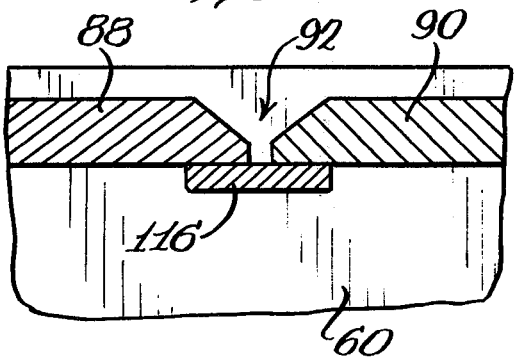
FIG. 11 is a sectional view taken along line 11—11 in FIG. 6.

A bottom plate assembly 94 is welded to the outside side plate assemblies 54 adjacent to the lower peripheries thereof. Bottom plate assembly 94 includes a pair of plates 96 and 98, which are welded together in an end to end abutting relationship at 100. Plate 96 is welded at one end to bearing 70 and terminates at its other end a short distance from plate 58. Plate 98 extends from the forward edge of plate 96 and terminates a short distance from plate 56. A generally U-shaped plate 102 is welded at 104 and 106 to the forward edges of plates 90 and 98 in closing relationship thereto. Plate 102 extends between and is welded to plates 56 and 58. Referring to FIG. 11, the weld joints indicated at 92, 100, 104 and 106 are provided with weld strips 116 which extend across and are welded along the entire length of the joints. An elongated slot 107 is formed in plate 96 for receipt of rod 30 therethrough.

Figures 5, 6, 7:
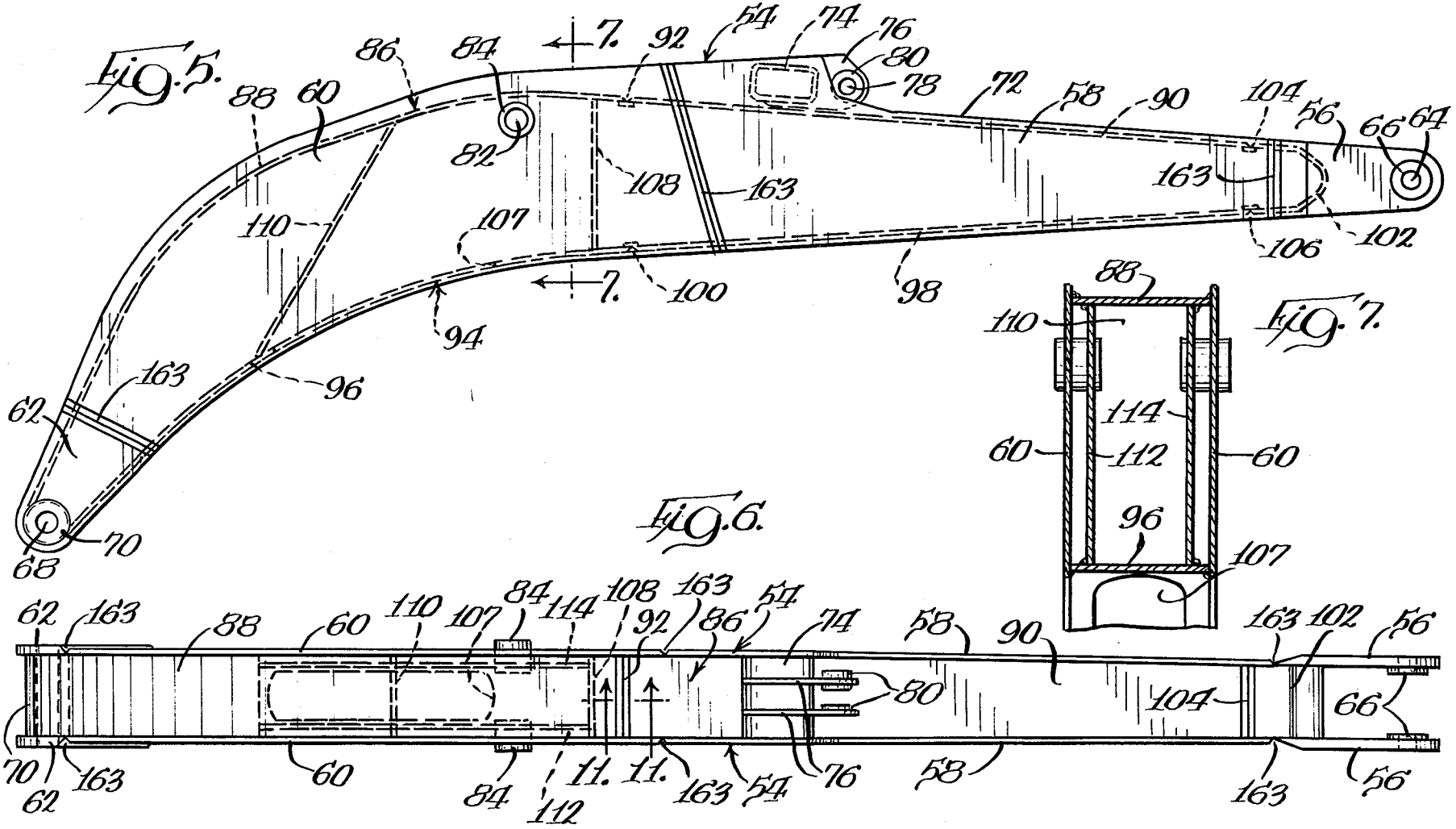
FIG. 5 is an enlarged side elevational view of the boom assembly constructed in accordance with the invention.
FIG. 6 is a top plan view of the boom assembly as shown in FIG. 5.
FIG. 7 is a sectional view taken along line 7—7 in FIG. 5.

An inside forward baffle plate 108 extends between plates 88 and 96 and the facing plates 60 and is welded thereto forwardly of bearing 84 and rearwardly of welds 92 and 100. An inside rear baffle plate 110 extends downwardly and rearwardly between plates 88 and 96 and the facing plates 60 and is welded thereto forwardly of bearing 84. Referring specifically to FIG. 7, a pair of inside center plates 112 and 114 are welded in place between baffle plates 108 and 110 and plates 88 and 96. Plates 112 and 114 are spaced a short distance from a corresponding plate 60 and are formed with openings therein for receipt of bearings 84 therethrough.

Referring to FIGS. 1–4, the specific construction of dipper stick 36 in accordance with the present invention will now be specifically described. Dipper stick 36 includes a pair of spaced apart side plate assemblies 120, which are of identical construction. The specific shape of the plate members which form assemblies 120 are as required, and shown in the drawings, to provide necessary clearances to prevent contact with other parts of the excavator during operation.

Side plate assemblies 120 are fabricated from an upper side plate 122, an intermediate side plate 124 and a lower side plate 126. Plates 122, 124 and 126 are respectively butt welded together in an end to end relationship in a manner which will be specifically described hereinbelow.

Upper side plate 122 is formed with an opening 128 through an upper portion thereof for receipt of a bearing 130 therethrough. Piston rod 50 of fluid motor 48 is connected to plate 122 by pin 53 passing through bearings 130 and rod 50. An opening 132 is formed in plate 122 through an intermediate portion thereof adjacent its rear edge for receipt of bearing 134 therethrough. Bearing 134 cooperates with bearings 66 for receipt of pin 37 therethrough so as to pivotally secure boom 22 to dipper stick 36.

Intermediate side plate 124 is formed with a lower undercut portion 136 so as to define an upper portion 138 protruding forwardly therefrom. An opening 140 is formed in portion 138 for receipt of bearing 142 therethrough. Cylinder 47 of fluid motor 40 is pivotally secured to plate 124 by pin 49 passing through bearings 142 and suitable connecting ears associated with the cylinder.

Lower side plate 126 is formed with an opening 144 through a lower portion thereof for receipt of bearing 146 therethrough. The lower end of plate 126 is pivotally secured to bucket 38 by pin 39 passing through bearing 146 and suitable connecting ribs associated with the bucket. An opening 148 is formed through an intermediate portion of plate 126 for receipt of bearing 150 therethrough. Rod 42 of fluid motor 32 is pivotally secured to plate 126 through linkage 46 by pin 43 passing through linkage 46 and bearing 150.

An end plate assembly 152 is welded between the side plate assemblies 120 generally adjacent to the outer peripheries thereof. End plate assembly 152 consists of plates 154, 156, 158 and 160. Plate 154 is welded to the inside surfaces of side plates 122, 124 and 126 and extends between bearings 134 and 150 and is welded thereto. Plate 156 is welded to side plates 126 and extends between bearings 146 and 150 and is welded thereto. Plate 158 is welded to side plates 122, 124 and 126 and extends from bearing 146 upwardly inside of bearing 142 and terminates a short distance short of bearing 130. Plate 158 is welded at its lower end to bearing 146. Plate 160 is welded to side plates 122 and extends between the end of plate 158 and bearing 134 and is respectively welded thereto. Accordingly, side plate assemblies 120 cooperate with end plate assembly 152 to form a box type structure.

Figure 4:
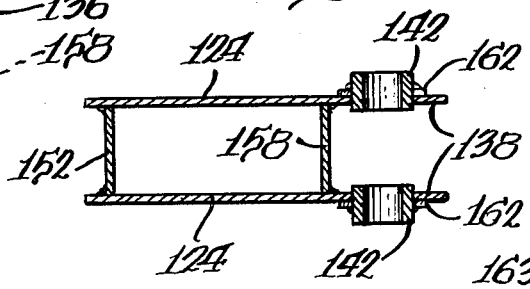
FIG. 4 is a sectional view taken along line 4—4 in FIG. 2.

Referring to FIG. 4, ring plates 162 are received around bearings 142 adjacent the outside surfaces of plates 124 and are suitably welded thereto.

The present invention provides a unique method of welding together the plates 56, 58, 60 and 62 of outside side plate assemblies 54 and the plates 122, 124 and 126 of side plate assemblies 120. As already discussed hereinabove, all of these plates are welded to an adjacent plate in an end to end abutting relationship. The method of the invention provides a technique to ensure that the weld penetrates over the entire length of the joint. Since all of the welds are substantially identical, only one such weld will be disclosed herein. All such joints are indicated by the numeral 163 in the drawings.

Figure 8:
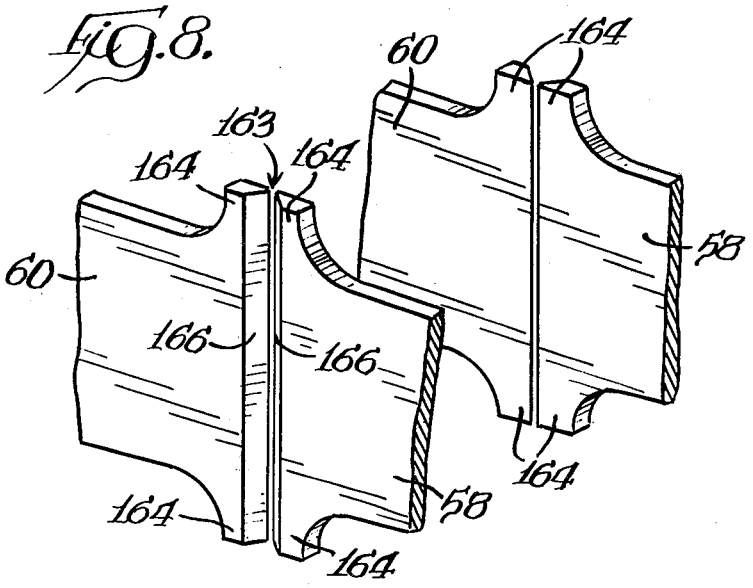
FIG. 8 is a perspective view of the outside and inside surfaces of two side plates which are to be welded together in accordance with the welding method of the present invention.
Figure 9:
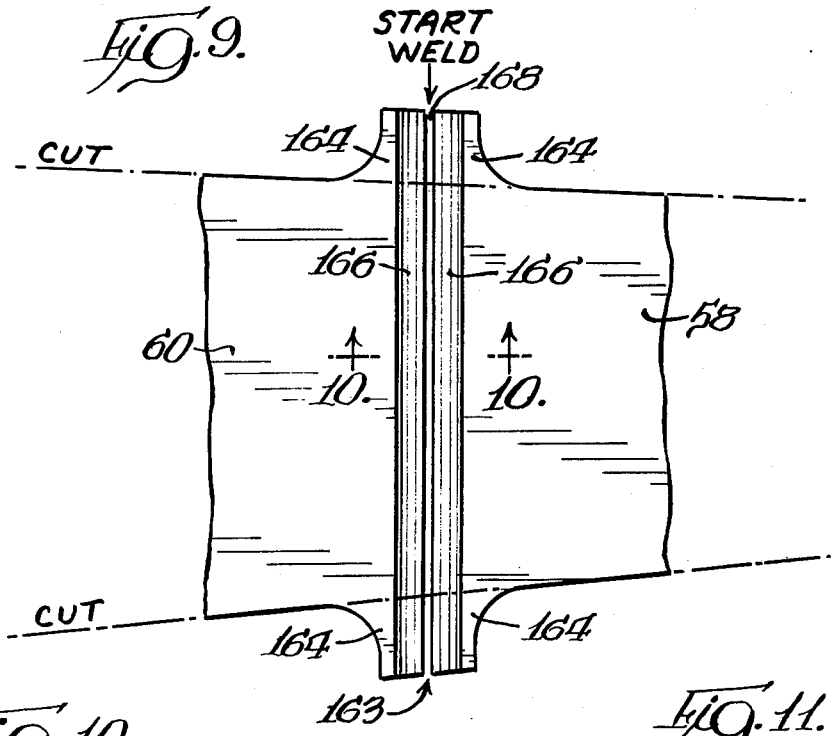
FIG. 9 is an enlarged elevational view of the outside surfaces of the side plates shown in FIG. 8.
Figure 10:
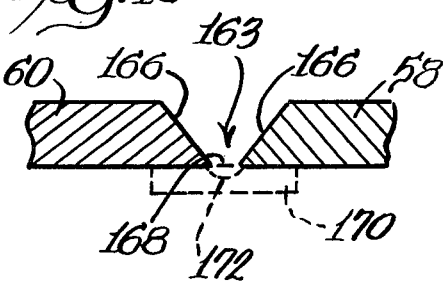
FIG. 10 is an enlarged sectional view taken along line 10—10 in FIG. 9 with the addition of the removable back-up strip shown in phantom lines.

Referring to FIGS. 8–10, the joint 163 between plates 58 and 60 is accomplished in the following manner. As seen in FIG. 8, it will be noted that plates 58 and 60 are formed with tab portions 164 which extend outwardly from the top and bottom surfaces thereof adjacent to the edges to be welded together. As seen in FIGS. 8 and 10, the edges are preferably bevelled as indicated at 166. The plates are positioned in an end to end relationship with the adjacent edges spaced a short distance apart, as indicated at 168. Referring to FIG. 10, a removable back-up strip 170, indicated in phantom lines, is positioned across the respective edges over the entire length thereof. Strip 170 is provided with a groove 172 formed therein in facing relationship to space 168. The weld material is applied between the respective edges over the entire length thereof, preferably in a top to bottom direction. The weld material fills the spaces between the edges and the groove 172. Upon completion of the application of the weld material, the strip 170 is removed. The tab portions 164 are then trimmed off flush with the top and bottom surfaces of the plates and the weld joint may be ground flush with the side surfaces of the plates. This welding technique provides a 100% weld penetration of all areas of the structure without the use of permanent back-up strips.

It will be appreciated that the present invention provides a specific boom structure and dipper stick structure which eliminates the necessity of utilizing doubler plates on the sides of the structures in high stress concentration areas as none exists in either structure. The butt joints on the side plates as well as the top and bottom plates are located with respect to the various hinge point locations in non-critical areas to provide for smooth and even stress flow with no stress risers. The design of the boom and dipper stick structures permits the manufacture thereof in sub-assemblies which may be placed together and welded to form the complete structure. Also, the specific method of butt welding of the side plates together provides a complete weld penetration along the entire length of the joint without the use of permanent back-up strips.

While the present invention has been described with reference to a particular embodiment, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. In an earth working vehicle having a self-powered frame structure, a platform supported on said frame structure, a boom having a first end pivotally secured to said platform about a substantially horizontal axis, a dipper stick pivoted intermediate its ends about a substantially horizontal axis to a second end of said boom, a material handling attachment pivoted to a first end of said dipper stick about a substantially horizontal axis, a first fluid motor means extending between said platform and an intermediate portion of said boom, a second fluid motor means extending between an intermediate portion of said boom and a second end of said dipper stick, and a third fluid motor means extending between an intermediate portion of said dipper stick and said material handling attachment; an improved boom construction comprising: a pair of spaced apart outside side plate assemblies, said outside side plate assemblies having front and rear connecting ear plates which have first and second bearing means respectively connected thereto for receipt of pivot pins to connect same respectively to said platform and said dipper stick, said side plate assemblies having front and rear side plates which are secured together in an end to end abutting relationship and secured between said connecting ear plates in an end to end abutting relationship, said front side plates having third bearing means mounted therebetween for pivotal receipt of said second fluid motor means, said rear side plates having fourth bearing means mounted therebetween for pivotal receipt of said first fluid motor means; a top plate assembly secured between the upper portions of said side plate assemblies; a bottom plate assembly secured between the lower portions of said side plate assemblies; an inside rear plate secured between said top plate assembly and said bottom plate assembly and said rear side plates rearward of said fourth bearing means; an inside forward plate secured between said top plate assembly and said bottom plate assembly and said rear side plates forward of said fourth bearing means; and a pair of spaced inside center plates secured between said inside rear plate and said inside forward plate so as to form a box structure therewith, said fourth bearing means extending through and secured to said rear side plates and said inside center plates.

2. The invention as defined in claim 1 wherein said bottom plate assembly has an elongated slot formed therein for receipt of said first fluid motor means therethrough.

3. The invention as defined in claim 2 wherein said bottom plate assembly includes a front bottom plate and a rear bottom plate which are welded together in an end to end abutting relationship forwardly of said inside forward plate.

4. The invention as defined in claim 3 wherein a backup strip is welded between the respective edges of said front bottom plate and said rear bottom plate.

5. The invention as defined in claim 3 wherein said top plate assembly includes a front top plate and a rear top plate which are welded together in an end to end abutting relationship forwardly of said inside forward plate.

6. The invention as defined in claim 5 wherein a backup strip is welded between the respective edges of said front top plate and said rear top plate.

7. The invention as defined in claim 5 wherein a generally U-shaped plate is welded in abutting relationship to said front bottom plate and said front top plate.

8. The invention as defined in claim 7 wherein backup strips are welded between the respective edges of said U-shaped plate and corresponding abutting edges of said front bottom plate and said front top plate.

9. The invention as defined in claim 1 wherein a tubular beam member extends between intermediate portions of said front side plates adjacent the upper edges thereof and said third bearing means are secured to connecting struts which are secured to said tubular beam member.

10. The invention as defined in claim 5 wherein said rear bottom plate and said rear top plate are welded to said first bearing means.

11. In an earth working vehicle having a self-powered frame structure, a platform supported on said frame structure, a boom having a first end pivotally secured to said platform about a substantially horizontal axis, a dipper stick pivoted intermediate its ends about a substantially horizontal axis to a second end of said boom, a material handling attachment pivoted to a first end of said dipper stick about a substantially horizontal axis, a first fluid motor means extending between said platform and an intermediate portion of said boom, a second fluid motor means extending between an intermediate portion of said boom and a second end of said dipper stick, and a third fluid motor means extending between an intermediate portion of said dipper stick and said material handling attachment; an improved dipper stick construction comprising: a pair of spaced apart side plate assemblies, said side plate assemblies having upper and lower side plates which are secured in an end to end abutting relationship to an intermediate side plate, said upper side plates having first and second bearing means connected thereto for respective connection to said second fluid motor means and said boom, said lower side plates having third bearing means connected thereto for connection to said material handling attachment, said intermediate side plates having fourth bearing means connected thereto for connection to said third fluid motor means, said fourth bearing means including a bearing cylinder extending through and welded to each of said intermediate side plates and a ring plate received around and welded to each of said bearing cylinders and said intermediate side plates; and an end plate assembly secured between said side plate assemblies generally adjacent the outer periphery thereof.

12. The invention as defined in claim 11 wherein said lower side plates have a fifth bearing means connected thereto above said third bearing means for connection to said third fluid motor means through link members extending therebetween.

13. The invention as defined in claim 12 wherein said end plate assembly includes a first plate extending between said second bearing means and said fifth bearing means, a second plate extending between said third bearing means and said fifth bearing means, a third plate extending from said third bearing means inside of said fourth bearing means and terminating a short distance below said first bearing means, and a fourth plate extending between said second bearing means and the upper end of said third plate.

* * * * *